US010845124B2

(12) United States Patent
Sugimura et al.

(10) Patent No.: US 10,845,124 B2
(45) Date of Patent: Nov. 24, 2020

(54) HEAT EXCHANGER

(71) Applicant: DENSO CORPORATION, Kariya (JP)

(72) Inventors: Ryohei Sugimura, Kariya (JP); Hiroshi Mieda, Kariya (JP); Masaaki Kawakubo, Kariya (JP); Daiki Kato, Kariya (JP); Tetsuya Ito, Kariya (JP)

(73) Assignee: DENSO CORPORATION, Kariya (JP)

( * ) Notice: Subject to any disclaimer, the term of this patent is extended or adjusted under 35 U.S.C. 154(b) by 119 days.

(21) Appl. No.: 16/091,917

(22) PCT Filed: Apr. 3, 2017

(86) PCT No.: PCT/JP2017/013976
§ 371 (c)(1),
(2) Date: Oct. 5, 2018

(87) PCT Pub. No.: WO2017/175725
PCT Pub. Date: Oct. 12, 2017

(65) Prior Publication Data

US 2019/0092135 A1 Mar. 28, 2019

(30) Foreign Application Priority Data

Apr. 8, 2016 (JP) ..... 2016-078225
Mar. 31, 2017 (JP) ..... 2017-070672

(51) Int. Cl.
*F28D 1/04* (2006.01)

(52) U.S. Cl.
CPC ..... *F28D 1/0417* (2013.01)

(58) Field of Classification Search
CPC ..... F28D 1/0417; F28D 1/05375; F28D 1/05391; F28D 1/0443; F25B 2400/13; F25B 2400/23; F25B 2500/18; F25B 2339/044; F25B 39/04
See application file for complete search history.

(56) References Cited

U.S. PATENT DOCUMENTS 4,466,253 A * 8/1984 Jaster ..... F22B 3/045 60/686
5,154,061 A * 10/1992 Weisshaar ..... B01D 5/0024 122/492
5,224,358 A * 7/1993 Yamanaka ..... F25B 39/04 62/509

(Continued)

FOREIGN PATENT DOCUMENTS

JP 4803199 B2 10/2011
JP 2014149123 A 8/2014

*Primary Examiner* — Ljiljana V. Ciric
(74) *Attorney, Agent, or Firm* — Harness, Dickey & Pierce, P.L.C.

(57) ABSTRACT

A heat exchanger includes a liquid reservoir configured to separate a gas-liquid two-phase refrigerant flowing out of an upstream heat exchanging portion into a gas-phase refrigerant and a liquid-phase refrigerant, and a refrigerant adjustment portion configured to adjust an outflow state and an outflow destination of the refrigerant flowing out of a downstream heat exchanging portion or the liquid reservoir. The liquid reservoir includes a liquid reserving portion configured to store the liquid-phase refrigerant and a gas reserving portion configured to store the gas-phase refrigerant. The refrigerant adjustment portion faces the liquid reserving portion across the gas reserving portion.

18 Claims, 15 Drawing Sheets

(56) References Cited

U.S. PATENT DOCUMENTS 5,228,315 A * 7/1993 Nagasaka ..... F25B 39/04 165/110
5,394,710 A * 3/1995 Matsuo ..... B60H 1/3229 165/113
5,537,839 A * 7/1996 Burk ..... F25B 39/04 62/474
5,546,761 A * 8/1996 Matsuo ..... F25B 39/04 165/173
5,592,830 A * 1/1997 Baba ..... F25B 39/04 165/132
5,813,249 A * 9/1998 Matsuo ..... B60H 1/3229 165/132
5,875,650 A * 3/1999 Nobuta ..... B60H 1/3227 62/509
5,884,503 A * 3/1999 Inaba ..... F25B 39/04 62/509
RE36,408 E * 11/1999 Yamanaka ..... F25B 39/04 62/509
5,996,360 A * 12/1999 Tanaka ..... B60H 1/00907 62/159
6,006,532 A * 12/1999 Suzuki ..... B60H 1/3225 62/225
6,341,647 B1 * 1/2002 Nobuta ..... F25B 39/04 165/132
6,374,632 B1 * 4/2002 Nobuta ..... F25B 39/04 165/143
6,457,325 B1 * 10/2002 Vetter ..... F25B 31/004 62/473
6,694,773 B1 * 2/2004 Snow ..... F25B 39/04 62/474
9,488,395 B2 * 11/2016 Matsumoto ..... F25B 40/02
2002/0002841 A1 * 1/2002 Izawa ..... B60H 1/323 62/509
2002/0124593 A1 * 9/2002 Yamazaki ..... B60H 1/3229 62/509
2003/0140652 A1 * 7/2003 Yamazaki ..... F25B 39/04 62/509
2003/0177783 A1 * 9/2003 Yamasaki ..... B60H 1/3227 62/509
2004/0007012 A1 * 1/2004 Lee ..... B23P 15/26 62/474
2004/0074246 A1 * 4/2004 Kurata ..... B60H 1/00328 62/196.4
2004/0118150 A1 * 6/2004 Yamada ..... F25B 41/06 62/512
2004/0216863 A1 * 11/2004 Hu ..... F28D 1/0443 165/110
2004/0237577 A1 * 12/2004 Nishida ..... B60H 1/00978 62/503
2005/0039893 A1 * 2/2005 Nobuta ..... F25B 39/04 165/132
2005/0126210 A1 * 6/2005 Knecht ..... F25B 43/003 62/474
2005/0126214 A1 * 6/2005 Knecht ..... F25B 43/003 62/509
2005/0204772 A1 * 9/2005 Patel ..... F25B 43/003 62/509
2007/0169512 A1 * 7/2007 Ishizaka ..... F25B 5/04 62/515
2007/0261433 A1 11/2007 Mikita et al.
2008/0149312 A1 * 6/2008 Shembekar ..... F25B 39/04 165/132
2008/0196446 A1 * 8/2008 Nakamura ..... F25B 5/04 62/498
2009/0241573 A1 10/2009 Ikegami et al.
2010/0139313 A1 * 6/2010 Taras ..... F25B 39/00 62/498
2011/0174015 A1 * 7/2011 Nagano ..... F25B 41/00 62/515
2012/0111547 A1 * 5/2012 Suzuki ..... F25B 39/04 165/173
2014/0231279 A1 * 8/2014 Moreau ..... F25B 43/003 206/204
2016/0040916 A1 * 2/2016 Hanafusa ..... F25B 39/04 165/104.21
2016/0375744 A1 * 12/2016 Kakizaki ..... B60H 1/3204 62/160
2017/0016657 A1 * 1/2017 Hosokawa ..... F25B 43/006
2017/0246933 A1 * 8/2017 Lee ..... F25B 1/00
2018/0017297 A1 * 1/2018 Arino ..... F25B 39/00
2018/0058737 A1 * 3/2018 Nagafuji ..... F25B 39/04
2018/0135904 A1 * 5/2018 Nagafuji ..... F25B 43/02
2018/0164006 A1 * 6/2018 Numasawa ..... F25B 39/04
2019/0092135 A1 * 3/2019 Sugimura ..... F28D 1/0417
2019/0128575 A1 * 5/2019 Sugimura ..... F25B 43/00

* cited by examiner

HEAT EXCHANGER

CROSS REFERENCE TO RELATED APPLICATIONS

This application is a U.S. National Phase Application under 35 U.S.C. 371 of International Application No. PCT/JP2017/013976 filed on Apr. 3, 2017. This application is based on and claims the benefit of priority from Japanese Patent Application No. 2016-078225 filed on Apr. 8, 2016 and Japanese Patent Application No. 2017-070672 filed on Mar. 31, 2017. The entire disclosures of all of the above applications are incorporated herein by reference.

TECHNICAL FIELD

The present disclosure relates to a heat exchanger.

BACKGROUND ART

Conventionally, for example as described in Patent Document 1 below, a refrigeration cycle device which uses this type of heat exchanger is known. The refrigeration cycle apparatus described in Patent Document 1 includes a gas-liquid separator for separating a refrigerant into a gas-phase refrigerant and a liquid-phase refrigerant, and a switching means for switching a refrigerant circuit, in which a refrigerant circulates, between a refrigerant circuit of a first mode and a refrigerant circuit of a second mode. Specifically, the gas-liquid separator separates the refrigerant flowing out of an outside heat exchanger into a gas-phase refrigerant and a liquid-phase refrigerant, discharges the gas-phase refrigerant from a gas-phase refrigerant outlet, and discharges the liquid-phase refrigerant from a liquid-phase refrigerant outlet. Further, the refrigerant circuit of the first mode is a refrigerant circuit that causes the liquid-phase refrigerant to flow out from the liquid-phase refrigerant outlet of the gas-liquid separator and into a second pressure reducing means and an evaporator, and further causes the liquid-phase refrigerant to be sucked into a compressor. The refrigerant circuit of the second mode is a refrigerant circuit that causes the gas-phase refrigerant to flow out from the gas-phase refrigerant outlet of the gas-liquid separator and to be sucked into the compressor.

PRIOR ART DOCUMENT

Patent Document

Patent Document 1: JP 2014-149123 A

SUMMARY OF THE INVENTION

Although there is no particular description in Patent Document 1, in the case where the valves constituting the refrigeration cycle is provided, it is preferable to provide the unit including the valves in the vicinity of the liquid reservoir in order to reduce the pressure loss of the gas-phase refrigerant flowing out of the liquid reservoir. However, in view of the fact that the heat exchanger and the liquid reservoir are disposed in a front part of the vehicle and the influence of water dripping from the liquid reservoir, there may be a high possibility that the valves are exposed to water, and some measures are required. Furthermore, when the valve is disposed in the vicinity of the liquid reservoir, in the refrigerant circuit of the first mode, heat of the high temperature gas flowing into the valve is more likely to be transferred to the liquid reservoir, and the refrigerant flowing into the reservoir may gasify. As the gasification of the refrigerant progresses, it leads to the outflow of the gas refrigerant and impedes the gas-liquid separation performance, so some measures are required.

It is an objective of the present disclosure to provide a heat exchanger in which water is unlikely to contact valves and a gas-liquid separation performance is secured in view of a thermal damage is secured in a configuration in which the valves of a refrigeration cycle are located close to the heat exchanger and a liquid reservoir.

A heat exchanger for a refrigeration cycle of the present disclosure includes: a heat exchanging portion configured to exchange heat between a refrigerant flowing through therein and air; a liquid reservoir configured to separate a gas-liquid two-phase refrigerant flowing out of the heat exchanging portion into a gas-phase refrigerant and a liquid-phase refrigerant, the liquid reservoir storing the liquid-phase refrigerant; and a refrigerant adjustment portion configured to adjust a flow state of the refrigerant flowing into the refrigerant adjustment portion through a refrigerant passage of the refrigeration cycle, supply the refrigerant to the heat exchanging portion, and adjust an outflow state and an outflow destination of the refrigerant flowing out of the heat exchanging portion or the liquid reservoir. The liquid reservoir includes a liquid reserving portion in which the liquid-phase refrigerant is stored and a gas reserving portion in which the gas-phase refrigerant is stored. The refrigerant adjustment portion faces the liquid reserving portion across the gas reserving portion.

According to the present disclosure, since the first adjustment portion and the second adjustment portion are provided above the liquid reservoir, the possibility of water attaching the first adjustment portion and the second adjustment portion can be surely reduced. Furthermore, since the refrigerant adjusting portion faces the liquid reserving portion across the gas reserving portion, a leakage of the gas refrigerant from the liquid reserving portion can be suppressed even when a part of the liquid-phase refrigerant is gasified due to a thermal damage caused by the refrigerant adjustment portion.

Furthermore, in a refrigerant circuit of a second mode, since a valve is provided at an outflow destination of the gas-phase refrigerant, an outflow path is a part where the pressure loss is high in the refrigeration cycle. In order to reduce the pressure loss, it is necessary to provide a flow path of a large diameter, and the vehicle mountability deteriorates. On the other hand, if the diameter of the flow path is decreased in consideration of the vehicle mountability, the pressure loss increases and the heating performance may be deteriorated. In contrast, since the refrigerant adjustment portion is located close to the gas reserving portion, a length of the flow path can be short even when the diameter of the flow path of the gas-phase refrigerant is increased. Accordingly, the vehicle mountability can be secured while the pressure loss is reduced.

EMBODIMENTS FOR EXPLOITATION OF THE INVENTION

Figure 1:
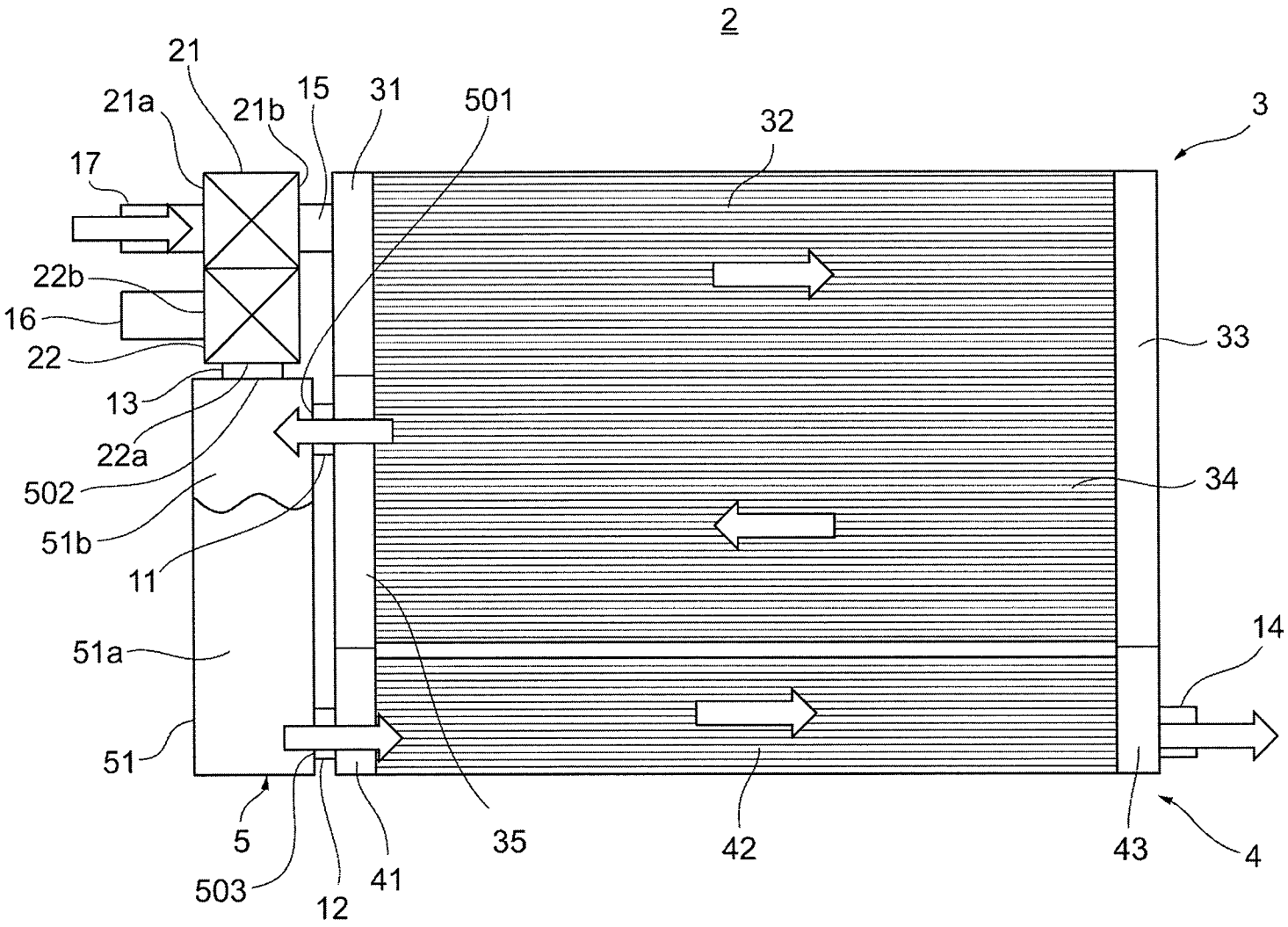
FIG. 1 is a diagram illustrating a heat exchanger in a cooling operation mode according to a first embodiment.

Hereinafter, the present embodiments will be described with reference to the attached drawings. In order to facilitate the ease of understanding, the same reference numerals are attached to the same constituent elements in each drawing where possible, and redundant explanations are omitted.

Figure 2:
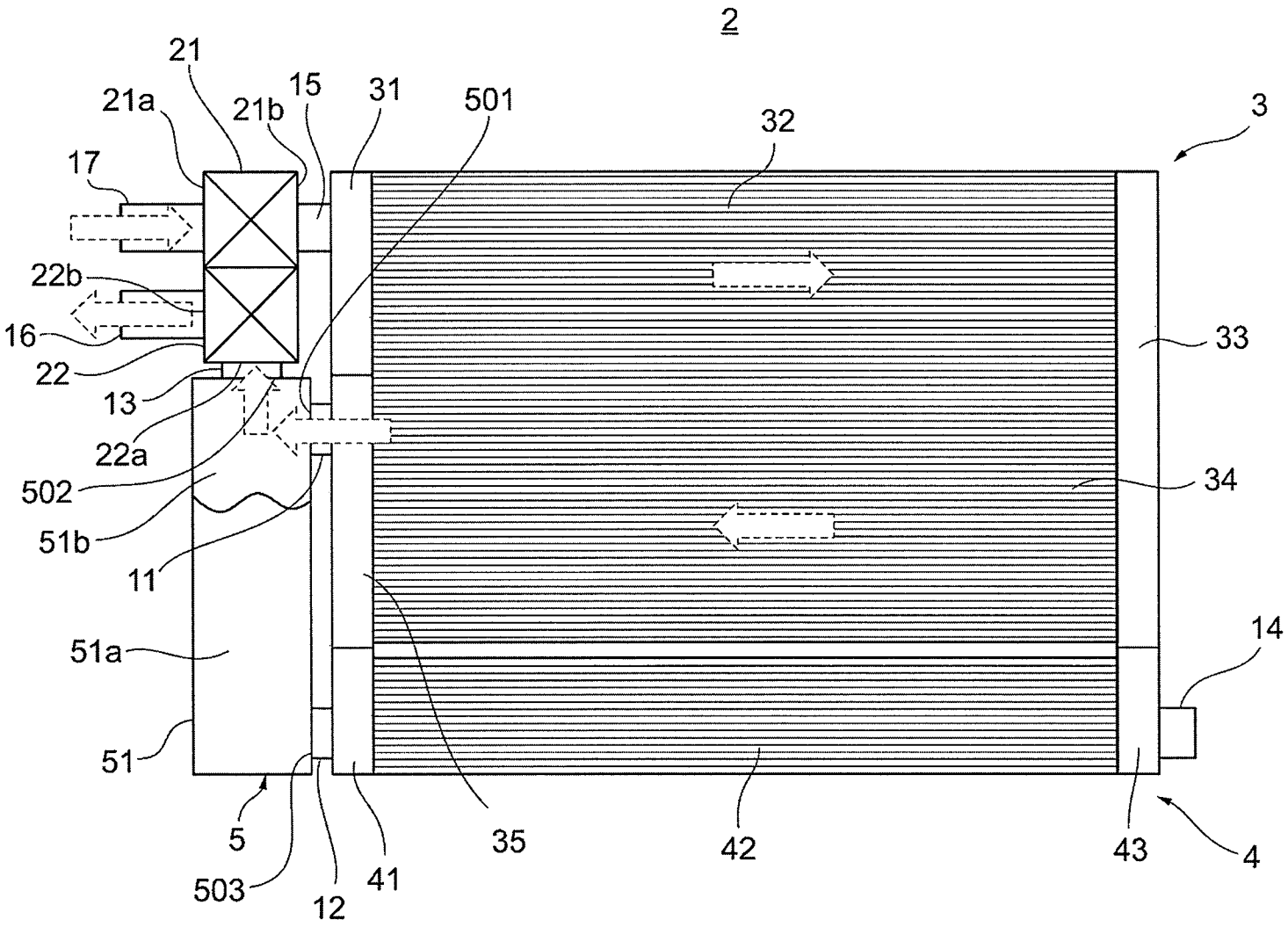
FIG. 2 is a diagram illustrating the heat exchanger in a heating operation mode according to the first embodiment.

As shown in FIGS. 1, 2, a heat exchanger 2 according to a first embodiment includes an upstream heat exchanging portion 3, a downstream heat exchanging portion 4, and a liquid reservoir 5. The upstream heat exchanging portion 3 has two upstream cores 32, 34 and header tanks 31, 33, 35. In the present embodiment, the illustrated example is provided with two upstream cores 32, 34, but the number of the core may be one, three or more. The upstream cores 32, 34 are parts that exchange heat between the refrigerant flowing therein and the air flowing outside, and includes tubes through which the refrigerant flows and fins provided between the tubes.

At the upstream end of the upstream core 32, the header tank 31 is attached. At the downstream end of the upstream core 34, the header tank 35 is attached. At the downstream end of the upstream core 32 and the upstream end of the upstream core 34, the header tank 33 extending across the both of the upstream cores 32, 34 is attached.

An inflow channel 15 is provided in the header tank 31. A connection channel 11 is provided in the header tank 35. The refrigerant flowing in from the inflow channel 15 flows into the upstream core 32 through the header tank 31. The refrigerant flowing through the upstream core 32 flows into the header tank 33. The refrigerant flowing through the header tank 33 flows into the upstream core 34. The refrigerant flowing through the upstream core 34 flows into the header tank 35. The refrigerant flowing into the header tank 35 flows out to the connection channel 11. The connection channel 11 is connected to the liquid reservoir 5. The refrigerant flowing out to the connection channel 11 flows into a liquid reserving portion 51 of the liquid reservoir 5.

The liquid reservoir 5 includes the liquid reserving portion 51, the connection channel 11, a connection channel 12, and a connection channel 13. The liquid reserving portion 51 is a portion that separates the gas-liquid two-phase refrigerant flowing therein from the connection channel 11 into a liquid-phase refrigerant and a gas-phase refrigerant, and stores the liquid-phase refrigerant.

The connection channel 11, the connection channel 12, and the connection channel 13 are connected to the liquid reserving portion 51. The connection channel 11 is a channel connecting the upstream heat exchanging portion 3 and the liquid reservoir 5. The connection channel 12 is a channel connecting the liquid reservoir 5 and the downstream heat exchanging portion 4. As shown in FIG. 1, the liquid-phase refrigerant flowing out from the connection channel 12 during the cooling operation flows into the downstream heat exchanging portion 4. The connection channel 13 is a channel that allows gas-phase refrigerant to flow out from the liquid reservoir 5.

The downstream heat exchanging portion 4 has a header tank 41, a downstream core 42, and a header tank 43. An outflow channel 14 is connected to the header tank 43. The header tank 43 is provided at the downstream end of the downstream core 42. At the upstream end of the downstream core 42, the header tank 41 is provided. The connection channel 12 is connected to the header tank 41.

The liquid-phase refrigerant flows from the connection channel 12 into the header tank 41, and the liquid-phase refrigerant flows from the header tank 41 into the downstream core 42. The downstream core 42 is a part that exchanges heat between the refrigerant flowing therein and the air flowing outside, and includes tubes through which the refrigerant flows and fins provided between the tubes. Accordingly, the liquid-phase refrigerant flowing into the downstream core 42 is directed to the header tank 43 while being subcooled.

The liquid-phase refrigerant flowing into the header tank 43 from the downstream core 42 flows out to the outflow channel 14. The outflow channel 14 is connected to an expansion valve included in the refrigeration cycle apparatus, and an evaporator is connected after the expansion valve.

Above the liquid reservoir 5, a first adjustment portion 21 and a second adjustment portion 22 as refrigerant adjustment portions are provided. The first adjustment portion 21 includes a high-pressure refrigerant inlet 21*a* and a refrigerant outlet 21*b*. The high-pressure refrigerant inlet 21*a* is an inflow port through which the high-pressure refrigerant flowing in from a compressor and a heat dissipation means flows in through a passage 17. The refrigerant outlet 21*b* is an outlet through which the inflowing refrigerant is let out at high pressure as it is or low pressure and flows out through the inflow channel 15 toward the upstream heat exchanging portion 3.

The second adjustment portion 22 includes a gas-phase refrigerant inlet 22*a* and a compressor connected outlet 22*b*. The gas-phase refrigerant inlet 22*a* is an inflow port through which the gas-phase refrigerant flowing out of the liquid reservoir 5 through the connection channel 13. The compressor connected outlet 22*b* is an outflow port through which the inflowing refrigerant is sent to the compressor through a compressor connected passage 16.

As described above, the heat exchanger 2 according to the first embodiment includes: the upstream heat exchanging portion 3 and the downstream heat exchanging portion 4 which exchange heat between the refrigerant flowing therein and the air; the liquid reservoir 5 that separates the gas-liquid two-phase refrigerant flowing out of the upstream heat exchanging portion 3 into the gas-phase refrigerant and the liquid-phase refrigerant, and stores the liquid-phase refrigerant; and the first adjustment portion 21 and the second adjustment portion 22 as the refrigerant adjustment portions which adjust a flow state of the refrigerant flowing therein through the refrigerant passage of the refrigeration cycle, supply the refrigerant to the upstream heat exchanging portion 3, and adjust an outflow state and an outflow destination of the refrigerant flowing out of the downstream heat exchanging portion 4 or the liquid reservoir 5. The liquid reservoir 5 includes a liquid reserving portion 51*a* in which the liquid-phase refrigerant is mainly stored and a gas reserving portion 51*b* in which the gas-phase refrigerant is mainly stored. The first adjustment portion 21 and the second adjustment portion 22 which are refrigerant adjustment portions faces the liquid reserving portion 51*a* across the gas reserving portion 51*b*.

Since the first adjustment portion 21 and the second adjustment portion 22 are provided above the liquid reservoir 5, the possibility of water contacting the first adjustment portion 21 and the second adjustment portion 22 can be surely reduced. Furthermore, since the first adjusting portion 21 and the second adjusting portion 22, which are the refrigerant adjusting portions, are disposed on the opposite side of the liquid reserving portion 51*a* across the gas reserving portion 51*b*, it is possible to prevent the gas refrigerant from flowing out of the liquid reserving portion 51*a* even when a part of the liquid-phase refrigerant is vaporized by the thermal damage due to the refrigerant adjustment portion. Further, it is possible to increase the diameter of the gas-phase refrigerant outflow path and make it short, and it is possible to achieve both suppression of pressure loss and ensuring of vehicle mountability.

Figure 3:
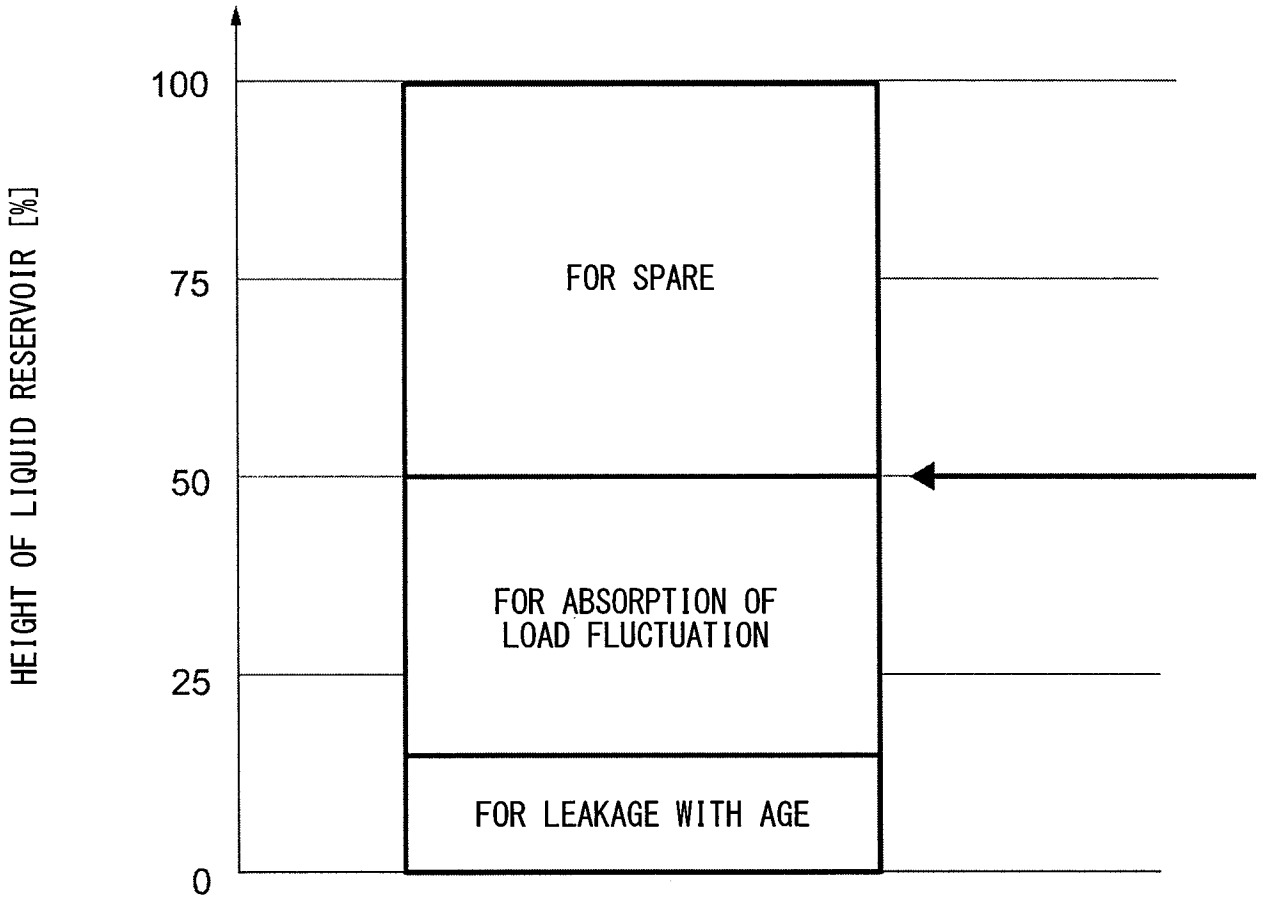
FIG. 3 is a view for explaining a liquid level inside a liquid reservoir.

The gas reserving portion 51*b* is disposed at a position that is half or more of the height of the liquid reserving portion 51. As shown in FIG. 3, the height of the liquid reservoir 5 is set by stack up "leakage with age", "absorption of load fluctuation", "spare etc." on top of each other. "Leakage with age" refers to an expected amount of refrigerant that leaks from various parts over a number of years of use when the heat exchanger 2 is used for the refrigeration cycle. "Absorption of load fluctuation" is an expected amount of fluctuation in the amount of liquid-phase refrigerant that flows in during the operation of the refrigeration cycle. Since the combined height of "leakage with age" and "absorption of load fluctuation" is liquid level required in the design of the liquid reservoir 5, the connection channel 12 is preferably provided above this height.

Figure 4:
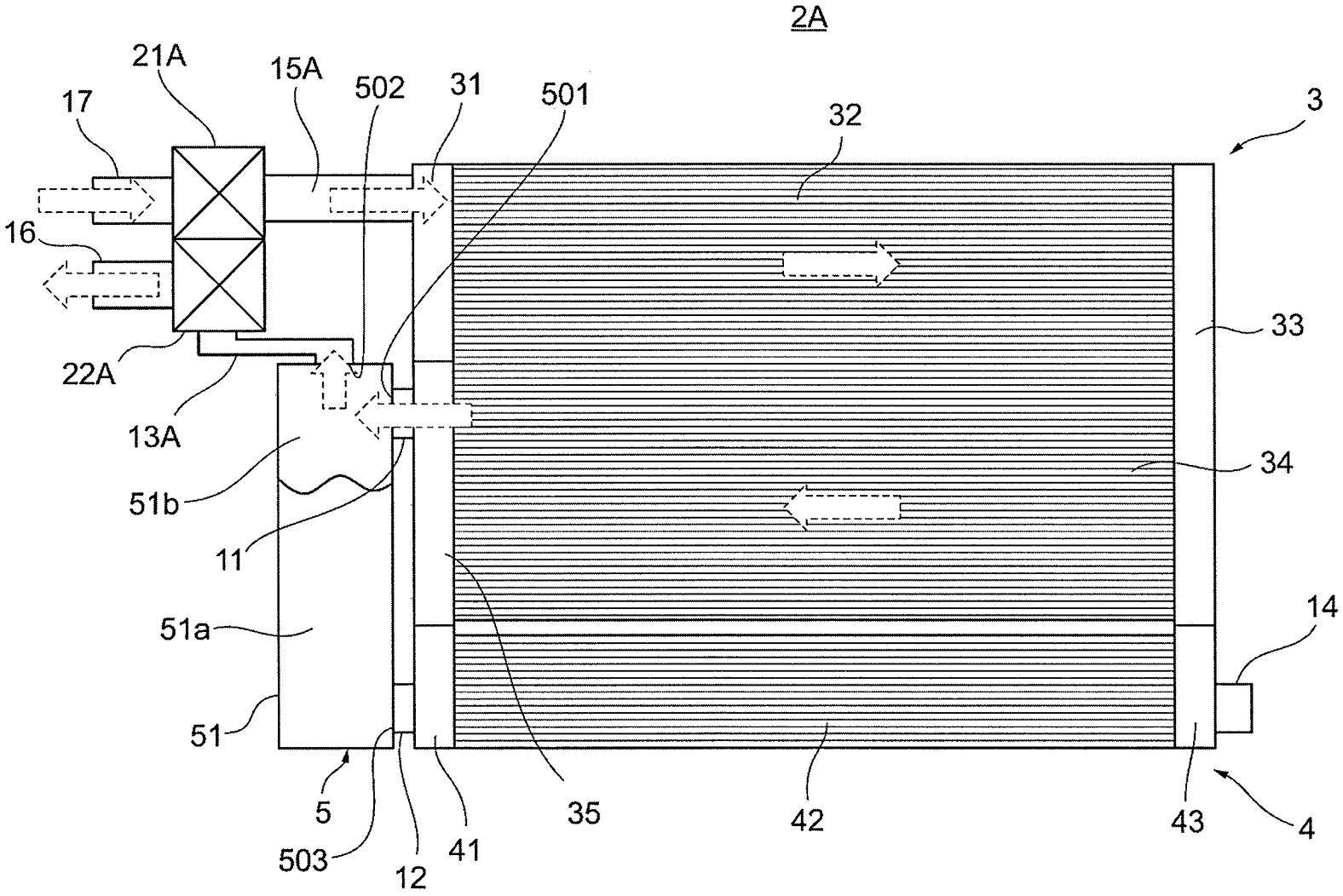
FIG. 4 is a view for explaining a heat exchanger according to a second embodiment.

As shown in FIG. 4, in a heat exchanger 2A according to a second embodiment, a first adjustment portion 21A and a second adjustment portion 22A are offset from and located above the liquid reservoir 5. Since the connection channel 13A has a crank shape, and the inflow channel 15A is extended, the first adjustment portion 21A and the second adjustment portion 22A can be positioned different from a position right above the liquid reservoir 5.

In the present embodiment, the connection channel 11 through which the gas-liquid two-phase refrigerant flowing out of the upstream heat exchanging portion 3 flows into the liquid reservoir 5 is provided. The connection channel 11 communicates with an inflow port 501 provided in the gas reserving portion 51*b*. With such a configuration, since the refrigerant that has exchanged heat in the upstream heat exchanging portion 3 is used to decrease the influence of the thermal damage due to the hot refrigerant flowing through the first adjustment portion 21 during the cooling operation. Since the influence of the thermal damage is decreased, filling characteristics of the liquid reservoir 5 can be improved. Further, during the heating operation, gas-liquid separation performance can be improved.

In the present embodiment, the first adjustment portion 21 and the second adjustment portion 22 which are the refrigerant adjustment portions and the liquid reservoir 5 are located on one end side of the upstream heat exchanging portion 3 and the downstream heat exchanging portion 4 in the refrigerant flow direction. According to such arrangement, the pipes can be shortened to suppress the increase of pressure loss of the refrigerant.

Further, in the present embodiment, the first adjustment portion 21, the second adjustment portion 22, and the liquid reservoir 5 are arranged such that a part of each of those overlaps with each other when the liquid reservoir 5 is viewed from the first adjustment portion 21 and the second adjustment portion 22 which are the refrigerant adjustment portions. More specifically, when viewed along a longitudinal direction of the liquid reservoir 5, i.e. when viewed from the upper side or the lower side of the liquid reservoir 5 in the longitudinal direction, they are arranged such that a part of each of them overlaps with each other. By arranging like this, space can be saved. However, as described with reference to FIGS. 1 and 2, the embodiment is not limited to arranging so that the first adjustment portion 21, the second adjustment portion 22, and the liquid reservoir 5 completely overlap with each other.

Figure 5:
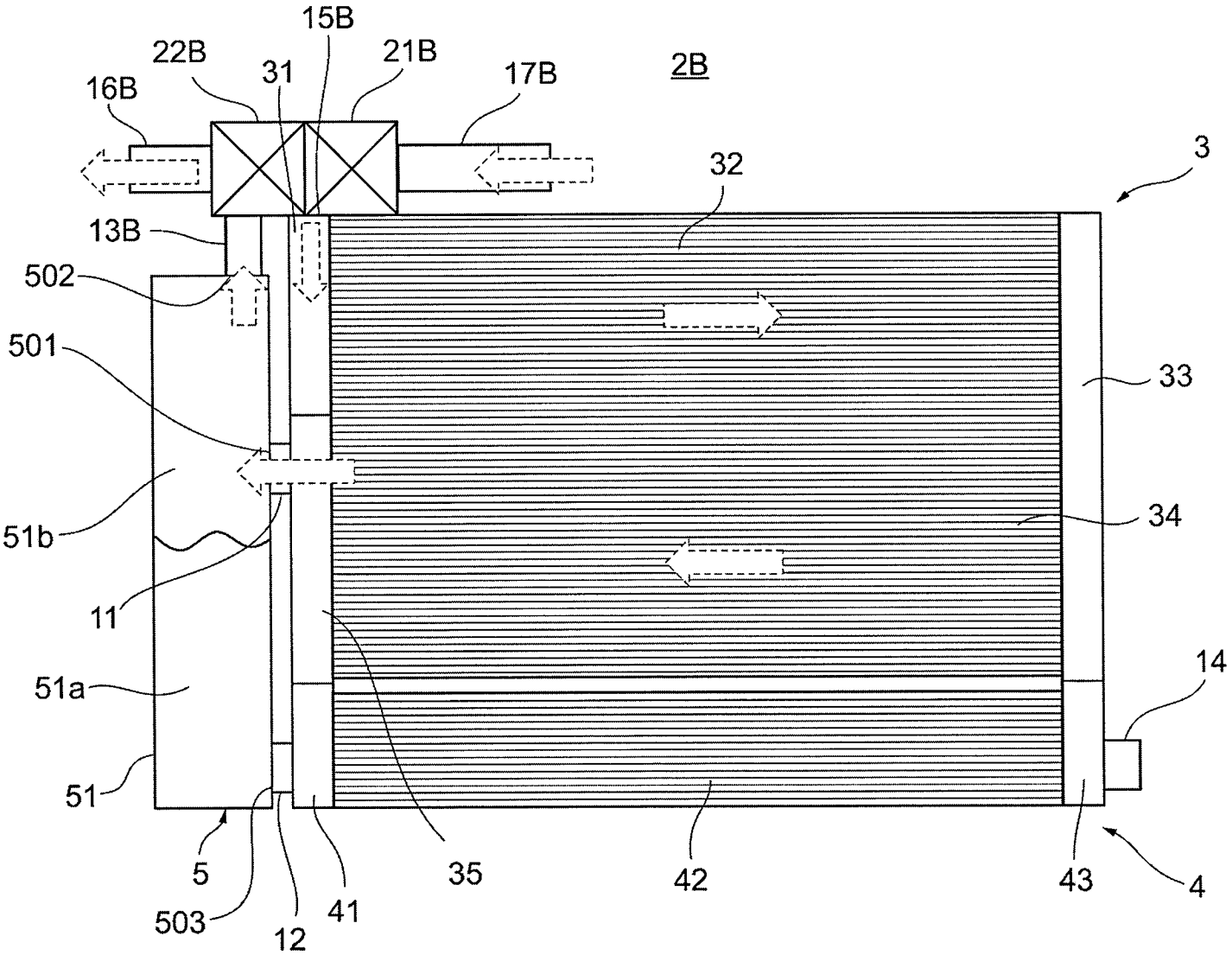
FIG. 5 is a view for explaining a heat exchanger according to a third embodiment.

As shown in FIG. 5, in a heat exchanger 2B according to a third embodiment, the first adjustment portion 21B and the second adjustment portion 22B are aligned with each other in a horizontal direction. The first adjustment portion 21B is connected to a flow path 17B and is located directly above the header tank 31. The first adjustment portion 21B and the header tank 31 are connected by an extremely short inflow channel 15B. The second adjustment portion 22B is located directly above the liquid reservoir 5. Since the distance between the liquid reservoir 5 and the second adjustment portion 22 is long, the connection channel 13B is elongated.

Further, in the present embodiment, the first adjustment portion 21 and the second adjustment portion 22 are connected to the connection channel 13B through which the refrigerant flows out of the upstream heat exchanging portion 3 and connected to the compressor connected passage 16B through which the refrigerant flows toward the compressor of the refrigeration cycle.

Figure 6:
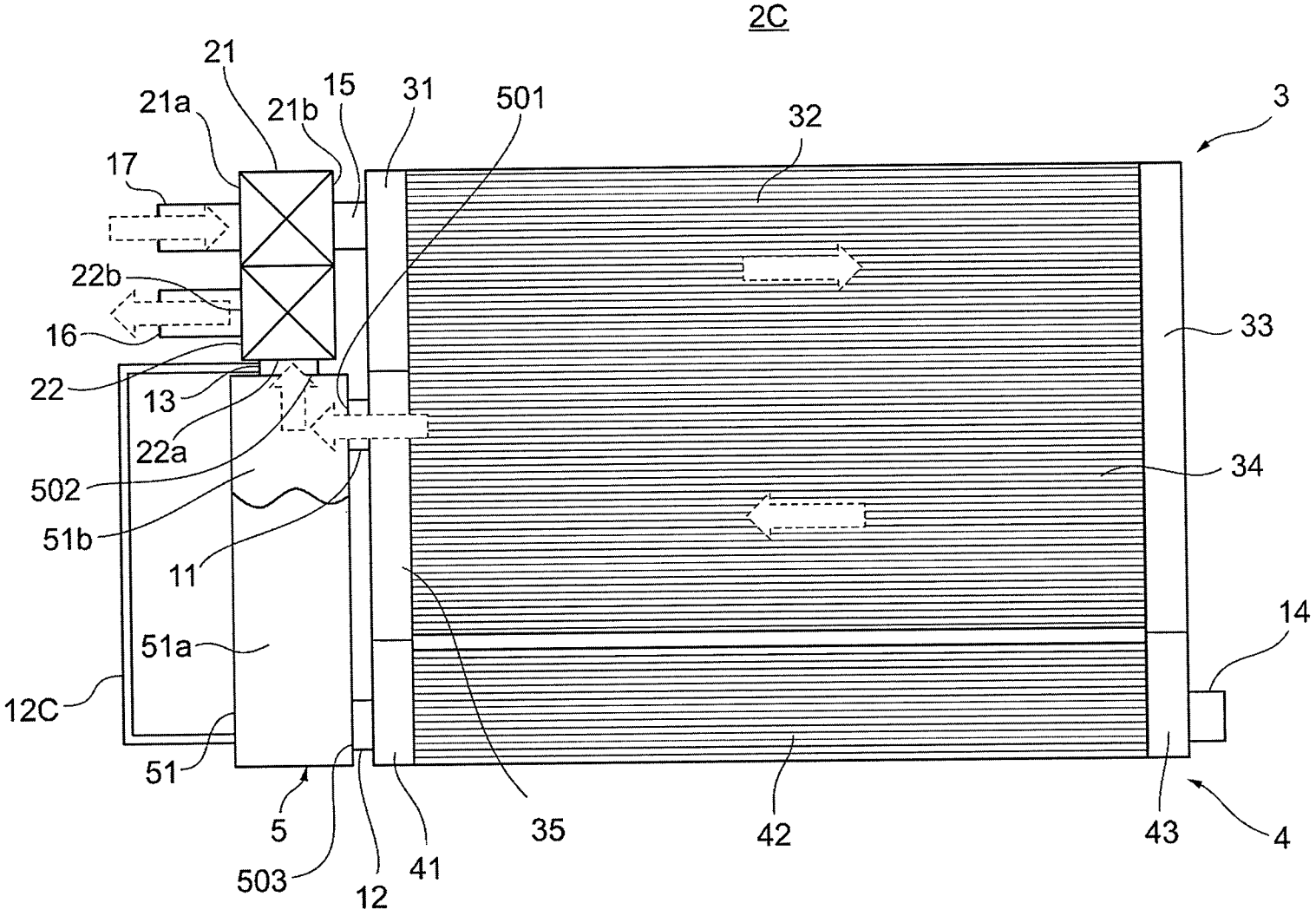
FIG. 6 is a view for explaining a heat exchanger according to a fourth embodiment.

As shown in FIG. 6, in a heat exchanger 2C according to a fourth embodiment, the liquid-phase refrigerant flowing out of the liquid reserving portion 51*a* of the liquid reservoir 5 joins with the refrigerant flowing out from a compressor connected outlet 22*b*. More specifically, a connection channel 12C connecting the lower portion of the liquid reservoir 5 and the connection channel 13 is provided.

Further, in the present embodiment, the upstream heat exchanging portion 3 which exchanges heat between the refrigerant flowing therein and the air and allows the refrigerant to flow out to the liquid reservoir 5, and the downstream heat exchanging portion 4 that exchanges heat between the air and the liquid-phase refrigerant flowing out of the liquid reservoir 5 are provided. The liquid reservoir 5, the first adjustment portion 21 and the second adjustment portion 22 which are the refrigerant adjustment portions, the upstream heat exchanging portion 3, and the downstream heat exchanging portion 4 are integrally connected with each other.

In the present embodiment, the first adjustment portion 21 is located between the refrigerant outlet 21*b* and the high-pressure refrigerant inlet 21*a* through which the high-pressure refrigerant flows from the compressor, and has a function of opening and closing the flow path and a function of decreasing the pressure of the refrigerant. The second adjustment portion 22 is located between the gas-phase refrigerant inlet 22*a* through which the gas-phase refrigerant from the liquid reservoir 5 flows in and the compressor connected outlet 22*b*, and has a function of opening and closing the flow path. The first adjusting portion 21 and the liquid reservoir 5 are provided so as to be positioned on opposite sides with the second adjusting portion 22 interposed therebetween. Since the second adjustment portion 22 is located on the side of the liquid reservoir 5, it is possible to arrange the gas-phase refrigerant inlet 22*a* at the shortest distance from the gas reserving portion 51*b*, and accordingly the pressure loss of the gas reserving portion can be suppressed. Since the first adjustment portion through which the hot refrigerant flows is located away from the liquid reservoir 5, the decrease in filling rate due to the thermal damage can be avoided. According to such arrangement, the heat from the first adjustment portion 21 through which the high-pressure refrigerant flows can be decreased by the second adjustment portion 22, the vaporization in the upper part of the liquid reservoir 5 can be suppressed, and the gas-liquid separation performance can be secured.

Figure 7:
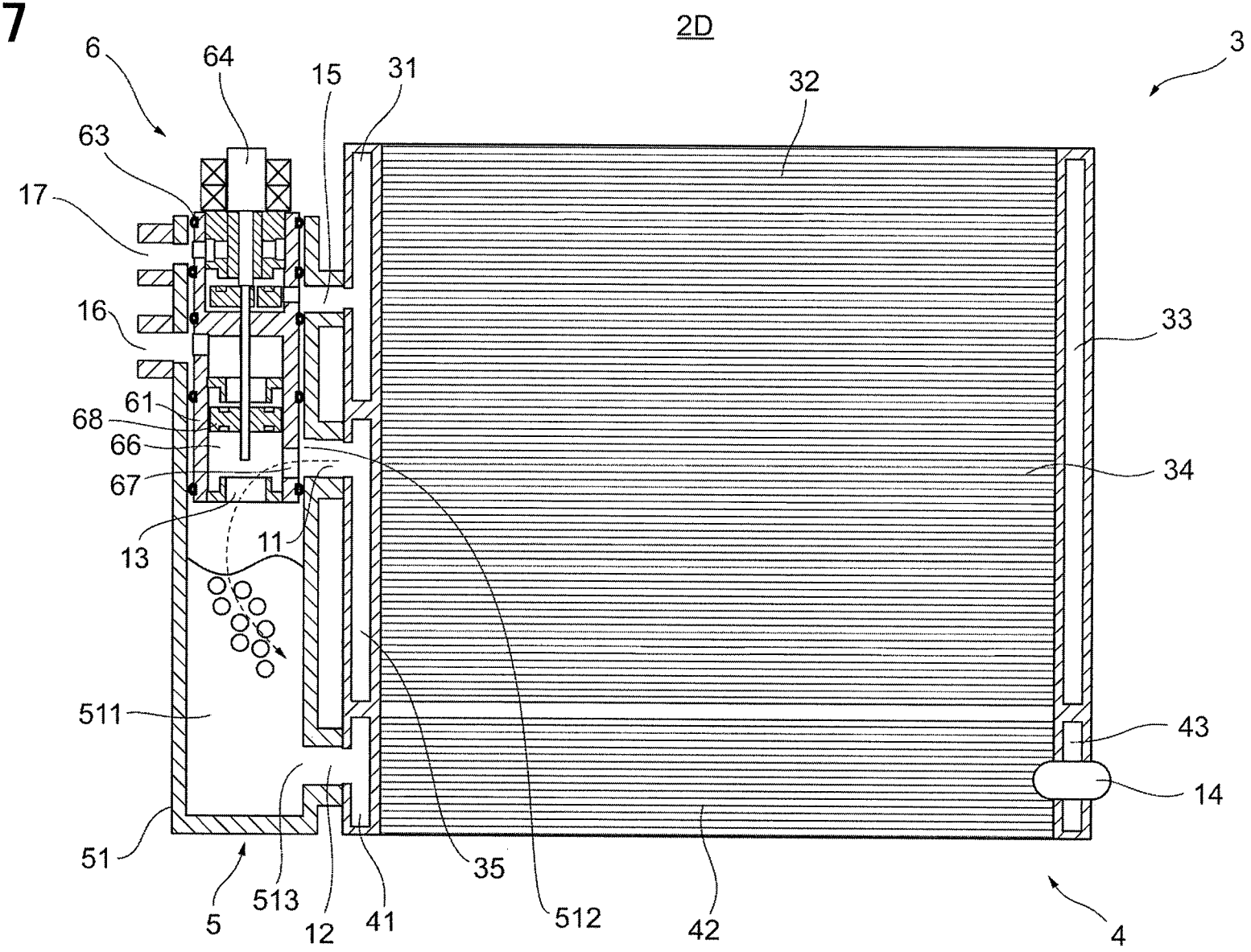
FIG. 7 is a view for explaining a heat exchanger according to a fifth embodiment.

As shown in FIG. 7, a heat exchanger 2D according to a fifth embodiment includes an upstream heat exchanging portion 3, a downstream heat exchanging portion 4, and a liquid reservoir 5. The upstream heat exchanging portion 3 has two upstream cores 32, 34 and header tanks 31, 33, 35. In the present embodiment, the illustrated example is provided with two upstream cores 32, 34, but the number of the core may be one, three or more. The upstream cores 32, 34 are parts that exchange heat between the refrigerant flowing therein and the air flowing outside, and includes tubes through which the refrigerant flows and fins provided between the tubes.

At the upstream end of the upstream core 32, the header tank 31 is attached. At the downstream end of the upstream core 34, the header tank 35 is attached. At the downstream end of the upstream core 32 and the upstream end of the upstream core 34, the header tank 33 extending across the both of the upstream cores 32, 34 is attached.

An inflow channel 15 is provided in the header tank 31. A connection channel 11 is provided in the header tank 35. The refrigerant flowing in from the inflow channel 15 flows into the upstream core 32 through the header tank 31. The refrigerant flowing through the upstream core 32 flows into the header tank 33. The refrigerant flowing through the header tank 33 flows into the upstream core 34. The refrigerant flowing through the upstream core 34 flows into the header tank 35. The refrigerant flowing into the header tank 35 flows out to the connection channel 11. The connection channel 11 is connected to the liquid reservoir 5.

The liquid reservoir 5 includes the liquid reserving portion 51, the connection channel 11, a connection channel 12, and a connection channel 13. The liquid reserving portion 51 is a portion that separates the gas-liquid two-phase refrigerant flowing therein from the connection channel 11 into a liquid-phase refrigerant and a gas-phase refrigerant, and stores the liquid-phase refrigerant.

The connection channel 11, the connection channel 12, and the connection channel 13 are connected to the liquid reserving portion 51. The connection channel 11 is a channel connecting the upstream heat exchanging portion 3 and the liquid reservoir 5. The connection channel 12 is a channel connecting the liquid reservoir 5 and the downstream heat exchanging portion 4. The liquid-phase refrigerant flowing out from the connection channel 12 flows into the downstream heat exchanging portion 4. The connection channel 13 is a channel connecting the liquid reservoir 5 and the refrigerant adjustment portion 6.

The liquid reserving portion 51 defines a liquid reservoir space 511 therein. The inflow port 512 and the outflow port 513 communicate with the liquid reservoir space 511. The connection channel 11 is connected to the inflow port 512. The connection channel 12 is connected to the outflow port 513.

The refrigerant adjustment portion 6 is provided above the liquid reservoir 5. The inflow channel 17 and the inflow channel 15 are connected to the refrigerant adjustment portion 6. The inflow channel 17 is a flow passage through which the high-pressure refrigerant from the compressor flows in. The inflow channel 15 is a channel through which the inflowing refrigerant is let out at high pressure as it is or low pressure and flows out toward the upstream heat exchanging portion 3.

The connection channel 13 and the compressor connected passage 16 are connected to the refrigerant adjustment portion 6. The connection channel 13 is a channel in which the gas-phase refrigerant flowing out of the liquid reservoir 5 flows. The compressor connected passage 16 is a flow path for sending the refrigerant flowing therein to the compressor.

The refrigerant adjustment portion 6 includes a body portion 61 in which a valve body and a valve seat is provided, a sealing portion 63, and an actuator 64 for actuating the valve body.

The refrigerant flowing out to the connection channel 11 flows into a buffer space 66 of the refrigerant adjustment portion 6 through the inflow port 512. The buffer space 66 is located above the connection channel 13. A communication hole 67 is provided so that the refrigerant flowing from the inflow port 512 can flow into the buffer space 66. The communication hole 67 is provided at a part of the body portion 61 facing the inflow port 512.

The refrigerant flowing through the inflow port 512 flows into the buffer space 66. Since the heat of the SH gas flowing from the connection channel 17 to the connection channel 15 can be cooled by the liquid refrigerant flowing through the connection channel 11, the vaporization in the upper part of the liquid reservoir space can be suppressed, and the gas-liquid separation performance can be secured.

The downstream heat exchanging portion 4 has a header tank 41, a downstream core 42, and a header tank 43. An outflow channel 14 is connected to the header tank 43. The header tank 43 is provided at the downstream end of the downstream core 42. At the upstream end of the downstream core 42, the header tank 41 is provided. The connection channel 12 is connected to the header tank 41.

The liquid-phase refrigerant flows from the connection channel 12 into the header tank 41, and the liquid-phase refrigerant flows from the header tank 41 into the downstream core 42. The downstream core 42 is a part that exchanges heat between the refrigerant flowing therein and the air flowing outside, and includes tubes through which the refrigerant flows and fins provided between the tubes. Accordingly, the liquid-phase refrigerant flowing into the downstream core 42 is directed to the header tank 43 while being subcooled.

The liquid-phase refrigerant flowing into the header tank 43 from the downstream core 42 flows out to the outflow channel 14. The outflow channel 14 is connected to an expansion valve included in the refrigeration cycle apparatus, and an evaporator is connected after the expansion valve.

As described above, in the present embodiment, the refrigerant adjustment portion 6 is located above the liquid reservoir space that is the liquid reserving portion. The inflow passage of the refrigerant connecting the upstream heat exchanging portion 3 and the liquid reservoir space 511 that is the liquid reserving portion passes through the refrigerant adjustment portion 6.

If the refrigerant adjustment portion 6 is just positioned above the liquid reservoir space 511, the liquid refrigerant may stay in the lower part of the liquid reservoir space 511 during the heating operation, and accordingly the amount of the refrigerant circulating in the refrigeration cycle may decrease. The decrease of the amount of the refrigerant may cause a deterioration of the heating performance and a decrease of the amount of circulating oil. If the amount of the circulating oil continues decreasing, the compressor may be locked. Since the flow passage of the refrigerant connecting the heat exchanging portion 3 and the liquid reservoir space 511 passes through the refrigerant adjustment portion 6, the refrigerant can return to the refrigeration cycle without flowing through the liquid reservoir space 511 in the heating operation.

Further, in the present embodiment, the connection channel 11 connected to the inflow port 512 and allowing the refrigerant flowing out of the upstream heat exchanging portion 3 to flow into the liquid reservoir space 511 that is the liquid reserving portion, and the connection channel 12 connected to the outflow port 513 and allowing the refrigerant flowing out of the upstream heat exchanging portion 3 into the liquid reservoir space 511 that is the liquid reserving portion to flow out to the heat exchanging portion 4 are provided. The outflow port 513 is located below the inflow port 512. The inflow port 512 is located above the liquid reservoir space 511 that is the liquid reserving portion.

Figure 8:
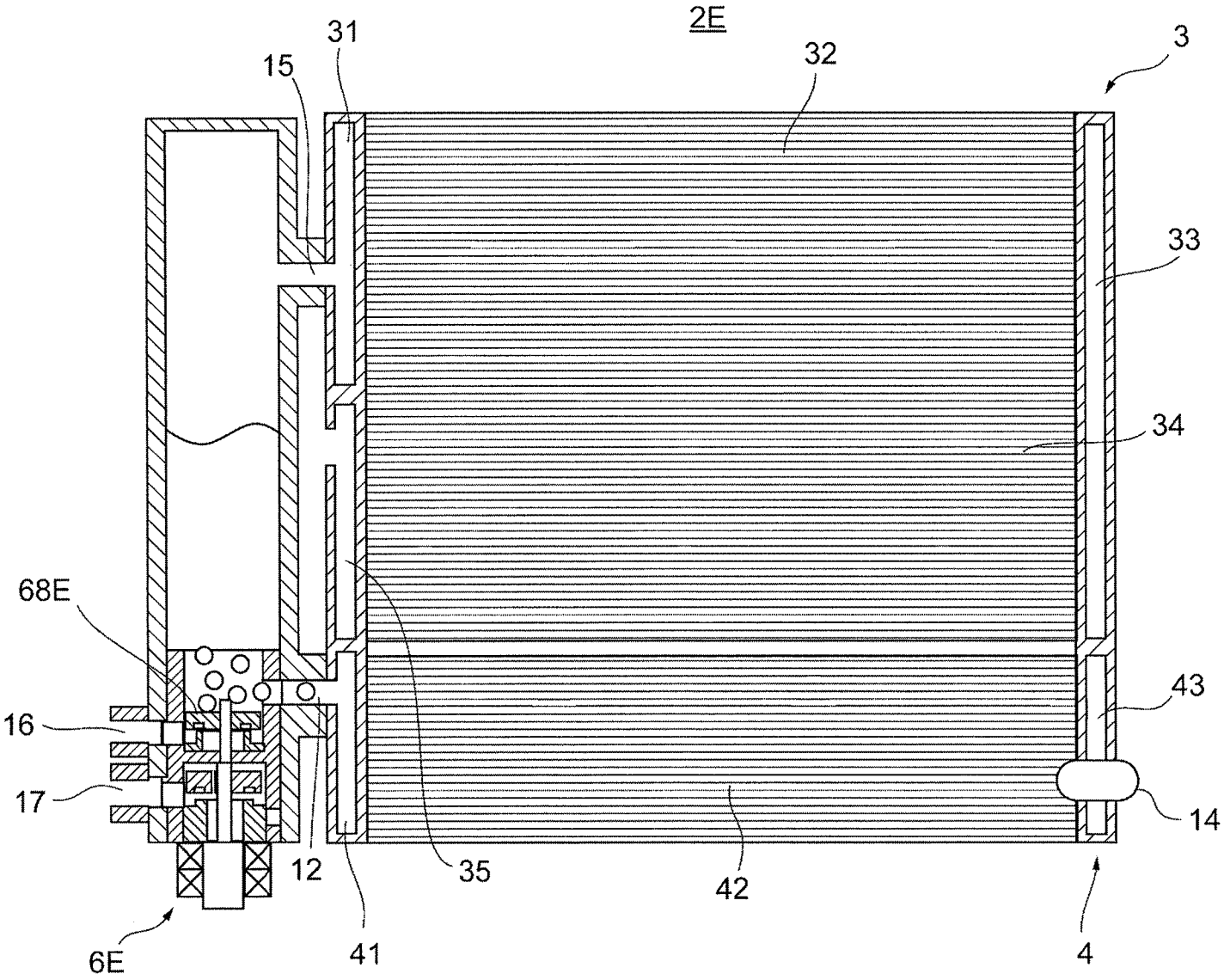
FIG. 8 is a view for explaining a heat exchanger according to a comparative example.

With such a configuration, even if a part of the refrigerant that has become a high temperature by passing through the refrigerant adjustment portion 6 is gasified, the refrigerant is cooled before reaching the outflow port 513, and accordingly the refrigerant containing the gas can be prevented from flowing into the heat exchanging portion 4. In contrast, in a heat exchanger 2E of a comparative example shown in FIG. 8, a refrigerant adjustment portion 6E is positioned at a lower position. Accordingly, when a temperature of a valve 68E becomes high, the refrigerant containing gas may flow into the heat exchanging portion 4. It is preferable to position the refrigerant adjustment portion 6 at an upper position as in the present embodiment in order to decrease the influence of the inflow of the gas.

Figure 9:
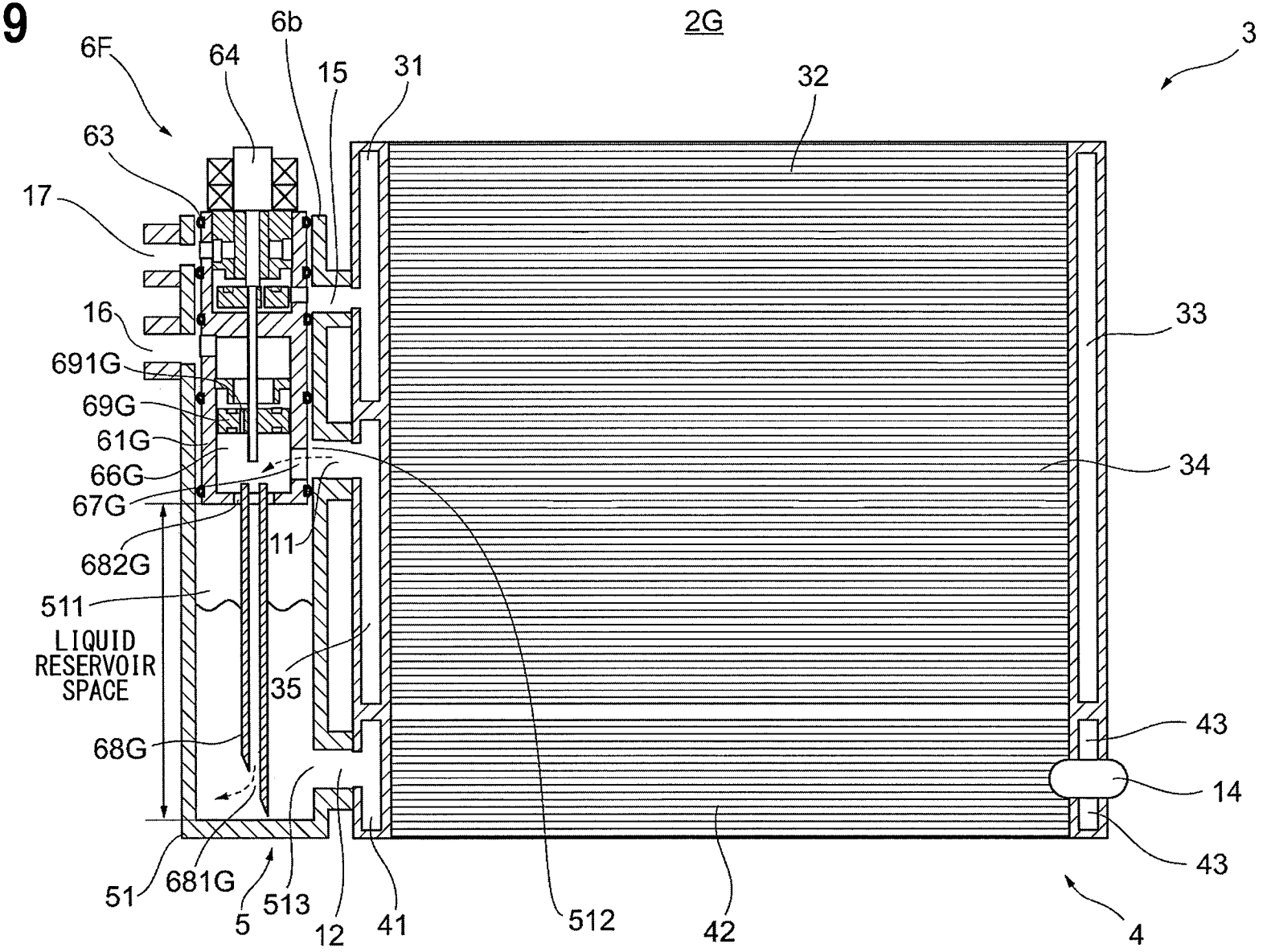
FIG. 9 is a view for explaining a heat exchanger according to a sixth embodiment.

A heat exchanger 2G according to a sixth embodiment shown in FIG. 9 further includes, in comparison to the heat exchanger 2D, a pipe 68G that suppress a disturbance of the surface of the liquid stored in the liquid reservoir due to the inflow of the liquid refrigerant from above. A lower end 681G of the pipe 68G is located below the outflow port 513.

A buffer space 66G is provided in a body portion 61G constituting a refrigerant adjustment portion 6F. A communication hole 67G is provided such that the refrigerant from the inflow port 512 flows into the buffer space 66G. The communication hole 67G is provided at a part of the body portion 61G facing the inflow port 512.

An opening portion 682G is positioned below the buffer space 66G of the body portion 61G. A pipe 68G extending through the opening portion 682G is provided. During the heating operation, the valve 69G moves downward to close the pipe 68G Since the valve 69G has a return hole 691G, the refrigerant moving upward from an opening provided at the lower end 681G returns to the refrigeration cycle through the return hole 691G.

Figure 10:
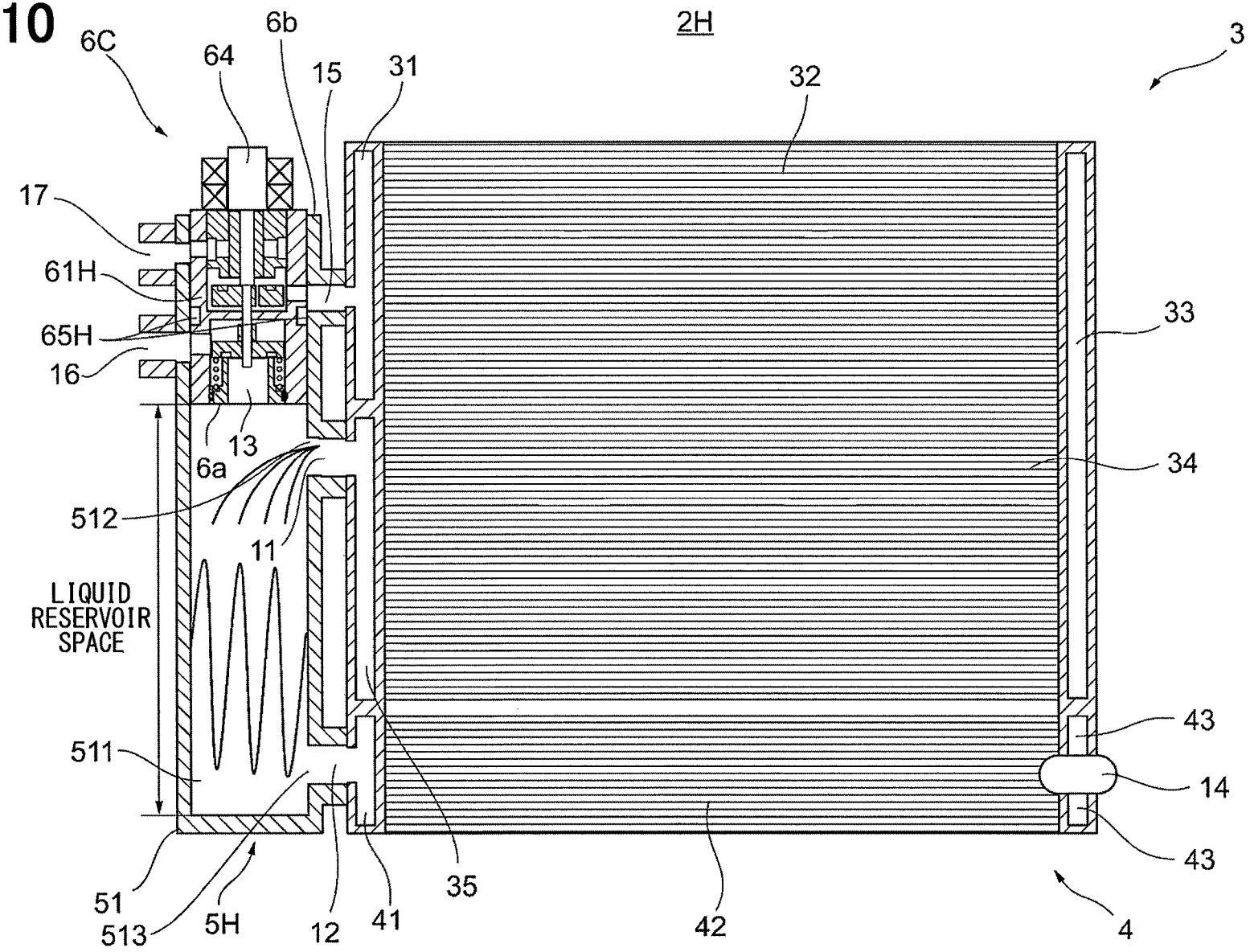
FIG. 10 is a view for explaining a liquid surface disturbance caused by inflow of liquid refrigerant.

In a heat exchanger 2H shown in FIG. 10, a gap portion 65H is provided without the sealing portion 63. A part of a body portion 61H is recessed to form the gap portion 65H. If the inflow port 512 is provided at an upper part so as to reduce a gasification region, the refrigerant flows in like a waterfall as shown in FIG. 10, and accordingly the surface of the liquid in the liquid reservoir space 511 may be disturbed.

Figure 11:
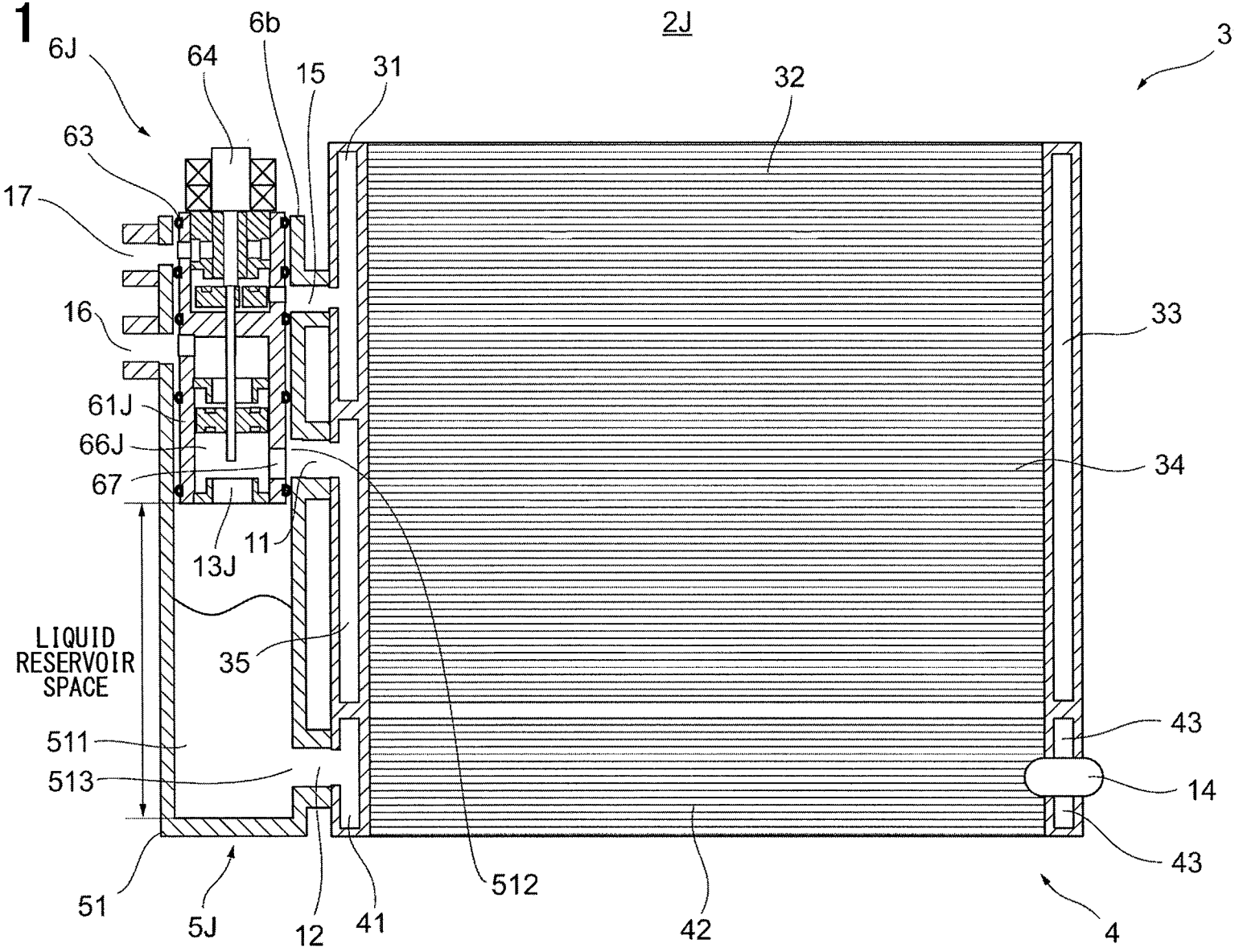
FIG. 11 is a view for explaining an example in which a buffer space is formed in a heat exchanger according to a seventh embodiment.

A heat exchanger 2J according to a seventh embodiment designed to avoid the disturbance of the liquid surface will be described with reference to FIG. 11. The heat exchanger 2J includes a liquid reservoir 5J and a refrigerant adjustment portion 6J. A buffer space 66J is defined in the refrigerant adjustment portion 6J.

The buffer space 66J is located above an outflow channel 13J. A communication hole 67 is provided so that the refrigerant flowing from the inflow port 512 can flow into the buffer space 66J. The communication hole 67 is provided at a part of the body portion 61J facing the inflow port 512.

The refrigerant flowing through the inflow port 512 flows into the buffer space 66J. The refrigerant temporarily stored in the buffer space 66J flows down through the outflow channel 13J to the liquid reservoir space 511. Therefore, the fall of the refrigerant becomes gentle, and the liquid surface disturbance is suppressed.

Figure 12:
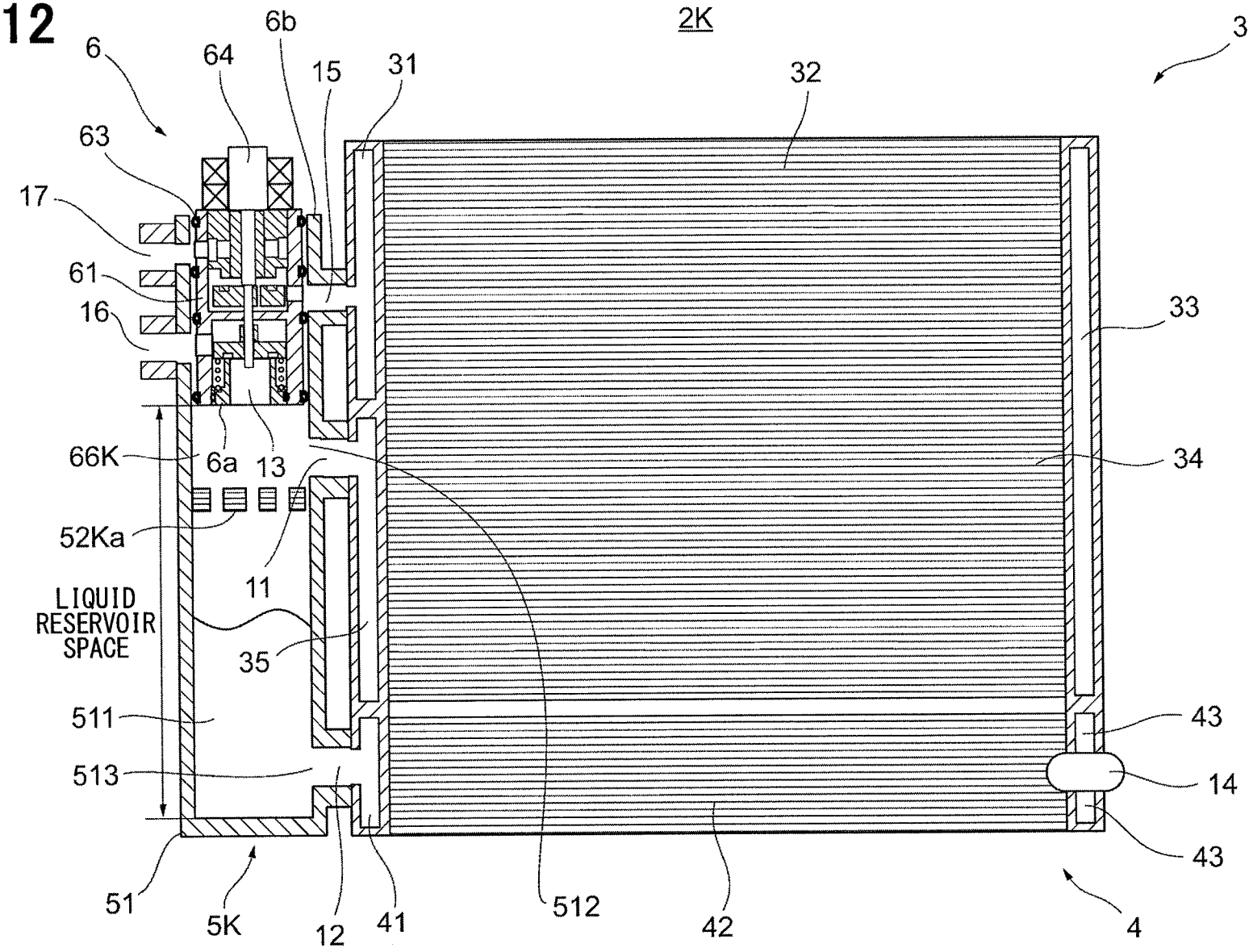
FIG. 12 is a view for explaining an example in which a buffer space is formed in the heat exchanger according to the seventh embodiment.

Next, a heat exchanger 2F designed to avoid the disturbance of the liquid surface will be described with reference to FIG. 12. The heat exchanger 2K includes a liquid reservoir 5K. A buffer space 66K is defined in the liquid reservoir 5K.

Figure 13:
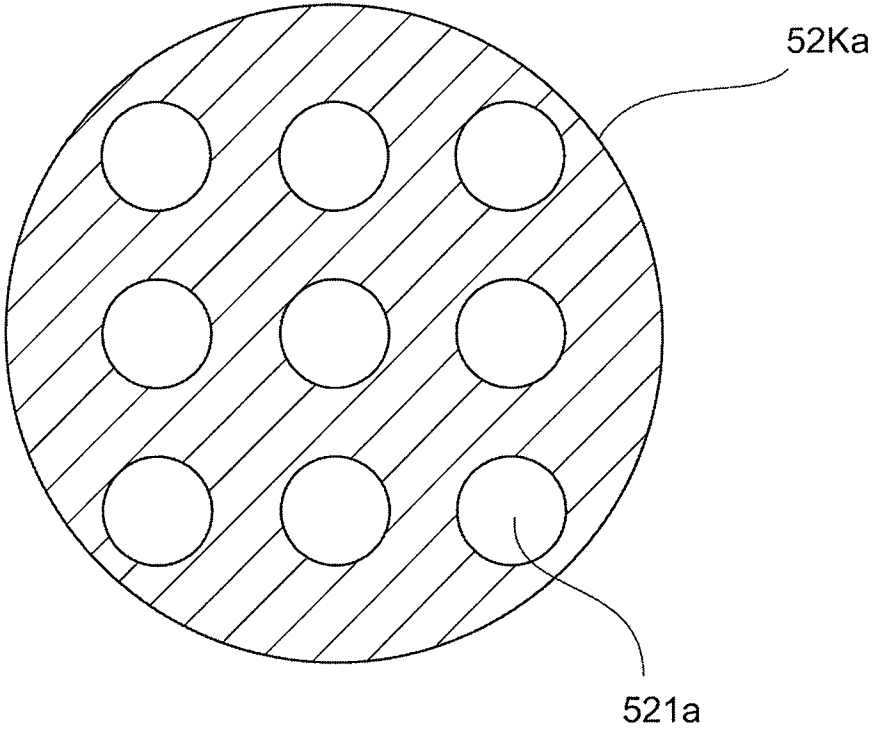
FIG. 13 is a view for explaining an example in which a buffer space is formed in the heat exchanger according to the seventh embodiment.
Figure 14:
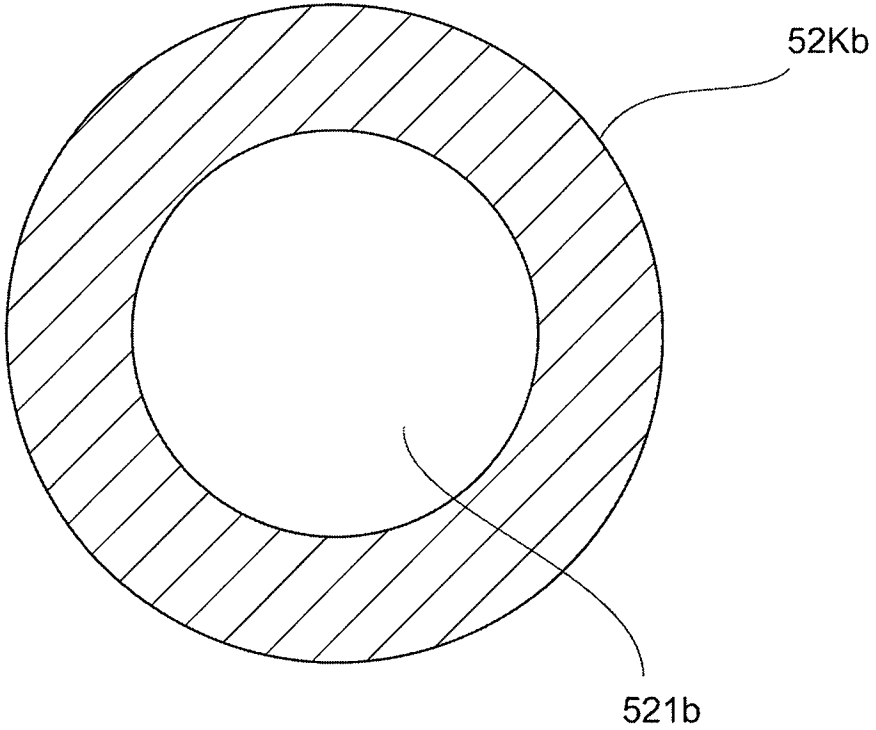
FIG. 14 is a view for explaining an example in which a buffer space is formed in the heat exchanger according to the seventh embodiment.
Figure 15:
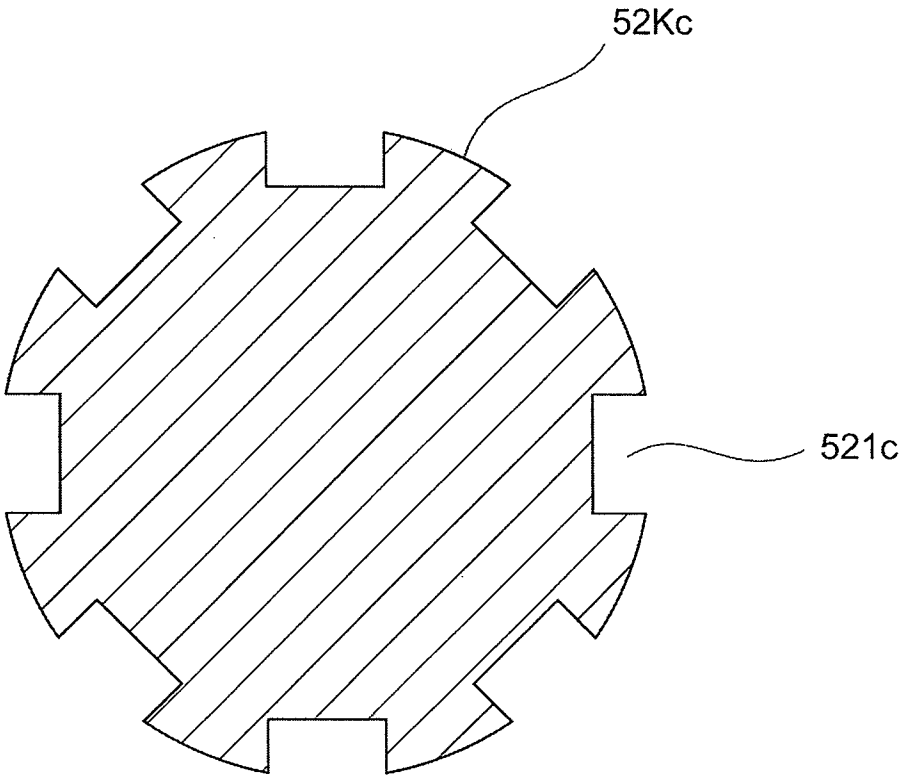
FIG. 15 is a view for explaining an example in which a buffer space is formed in the heat exchanger according to the seventh embodiment.

The buffer space 66K is provided between the refrigerant adjustment portion 6 and a buffer plate 52Ka. The buffer plate 52Ka is a plate member provided in the liquid reservoir space 511. As shown in FIG. 13, the buffer plate 52Ka is provided with multiple through-holes 521*a*. As shown in FIG. 14, a buffer plate 52Kb having a single through-hole 521*b* may be used. As shown in FIG. 15, a buffer plate 52Kc having notches 521*c* provided on an edge and defining gaps with an inner wall of the liquid reserving portion 51 can be used. Since the refrigerant flows along the inner wall surface of the liquid reserving portion 51 when the buffer plate 52Kc is used, the effect of suppressing the liquid surface disturbance is improved.

The embodiments have been described with reference to specific examples above. However, the present disclosure is not limited to these specific examples. Those skilled in the art appropriately design modifications to these specific examples, which are also included in the scope of the present disclosure as long as they have the features of the present disclosure. The elements, the arrangement, the conditions, the shape, etc. of the specific examples described above are not limited to those exemplified and can be appropriately modified. The combinations of elements included in each of the above described specific examples can be appropriately modified as long as no technical inconsistency occurs.

What is claimed is:

1. A heat exchanger for a refrigeration cycle, comprising:

a heat exchanging portion configured to exchange heat between a refrigerant and air;

a liquid reservoir configured to separate a gas-liquid two-phase refrigerant flowing out of the heat exchanging portion into a gas-phase refrigerant and a liquid-phase refrigerant, the liquid reservoir storing the liquid-phase refrigerant;

a refrigerant adjustment portion configured to adjust a flow state of the refrigerant flowing into the refrigerant adjustment portion through a refrigerant passage of the refrigeration cycle, supply the refrigerant to the heat exchanging portion, and adjust an outflow state and an outflow destination of the refrigerant flowing out of the heat exchanging portion or the liquid reservoir, wherein the liquid reservoir includes a liquid reserving portion configured to store the liquid-phase refrigerant, and a gas reserving portion configured to store the gas-phase refrigerant, the refrigerant adjustment portion faces the liquid reserving portion across the gas reserving portion, a buffer space is defined between an inflow port and a liquid surface in the liquid reserving portion, and the buffer space limits the refrigerant flowing from the inflow port from directly reaching the liquid surface.

2. The heat exchanger according to claim 1, wherein the refrigerant adjustment portion is located above the liquid reserving portion.

3. The heat exchanger according to claim 2, wherein a flow path of the refrigerant from the heat exchanging portion to the liquid reserving portion passes through the refrigerant adjustment portion.

4. The heat exchanger according to claim 1, further comprising a connection channel connected to the inflow port and configured to allow the refrigerant flowing out of the heat exchanging portion to flow into the liquid reserving portion, and a connection channel connected to an outflow port and configured to allow the refrigerant flowing out of the heat exchanging portion into the liquid reserving portion to flow out to the heat exchanging portion, wherein the outflow port is located below the inflow port, and the inflow port is located above the liquid reserving portion.

5. The heat exchanger according to claim 4, further comprising:

a pipe extending to guide the refrigerant to a position below the liquid surface of the refrigerant stored in the liquid reserving portion.

6. The heat exchanger according to claim 5, wherein the liquid reservoir has the outflow port through which the refrigerant stored in the liquid reserving portion flows out, and a lower end of the pipe is located below the outflow port.

7. The heat exchanger according to claim 1, wherein the inflow port communicates with an inside of the refrigerant adjustment portion, and the buffer space is defined inside the refrigerant adjustment portion.

8. The heat exchanger according to claim 1, wherein the buffer space is defined by a buffer plate provided in the liquid reserving portion between the inflow port and an other end.

9. The heat exchanger according to claim 8, wherein the buffer plate has a plurality of through-holes.

10. The heat exchanger according to claim 8, wherein a notch is provided on an edge of the buffer plate.

11. The heat exchanger according to claim 1, wherein the liquid reservoir and the refrigerant adjustment portion are located on one end side of the heat exchanging portion.

12. The heat exchanger according to claim 11, wherein a part of the refrigeration adjustment portion and a part of the liquid reservoir overlap each other when the liquid reservoir is viewed along a longitudinal direction of the liquid reservoir.

13. The heat exchanger according to claim 11, further comprising an outflow channel connecting the gas reserving portion of the liquid reservoir and the refrigerant adjustment portion.

14. The heat exchanger according to claim 11, wherein the refrigerant adjustment portion includes a refrigerant outlet through which the refrigerant flows out to the heat exchanging portion, and a compressor-connected outlet through which the refrigerant flows toward a compressor of the refrigeration cycle.

15. The heat exchanger according to claim 14, wherein the liquid-phase refrigerant flowing out of the liquid reserving portion of the liquid reservoir joins together with the refrigerant flowing from the compressor-connected outlet.

16. The heat exchanger according to claim 14, wherein the refrigerant adjustment portion includes a first adjustment portion located between the refrigerant outlet and a high-pressure refrigerant inlet through which a high-pressure refrigerant flowing from the compressor flows, the first adjustment portion being configured to open and close a passage and decrease a pressure of the refrigerant, and a second adjustment portion located between the compressor-connected outlet and a gas-phase refrigerant inlet through which the gas-phase refrigerant flowing from the liquid reservoir flows, and the first adjustment portion and the liquid reservoir are located opposite from each other across the second adjustment portion.

17. The heat exchanger according to claim 1, wherein the heat exchanging portion includes an upstream heat exchanging portion configured to exchange heat between the refrigerant and the air and send the refrigerant to the liquid reservoir, and a downstream heat exchanging portion into which the liquid-phase refrigerant flowing out of the liquid reservoir flows, the downstream heat exchanging portion being configured to exchange heat between the liquid-phase refrigerant and the air, and the liquid reservoir, the refrigerant adjustment portion, the upstream heat exchanging portion, and the downstream heat exchanging portion are integrated with each other.

18. A heat exchanger for a refrigeration cycle, comprising:

a heat exchanging portion configured to exchange heat between a refrigerant and air;

a liquid reservoir configured to separate a gas-liquid two-phase refrigerant flowing out of the heat exchanging portion into a gas-phase refrigerant and a liquid-phase refrigerant, the liquid reservoir storing the liquid-phase refrigerant;

a refrigerant adjustment portion configured to adjust a flow state of the refrigerant flowing into the refrigerant adjustment portion through a refrigerant passage of the refrigeration cycle, supply the refrigerant to the heat exchanging portion, and adjust an outflow state and an outflow destination of the refrigerant flowing out of the heat exchanging portion or the liquid reservoir, wherein the liquid reservoir includes a liquid reserving portion configured to store the liquid-phase refrigerant, and a gas reserving portion configured to store the gas-phase refrigerant, the refrigerant adjustment portion faces the liquid reserving portion across the gas reserving portion, the liquid reservoir and the refrigerant adjustment portion are located on one end side of the heat exchanging portion, the refrigerant adjustment portion includes a refrigerant outlet through which the refrigerant flows out to the heat exchanging portion, a compressor-connected outlet through which the refrigerant flows toward a compressor of the refrigeration cycle, a first adjustment portion located between the refrigerant outlet and a high-pressure refrigerant inlet through which a high-pressure refrigerant flowing from the compressor flows, the first adjustment portion being configured to open and close a passage and decrease a pressure of the refrigerant, and a second adjustment portion located between the compressor-connected outlet and a gas-phase refrigerant inlet through which the gas-phase refrigerant flowing from the liquid reservoir flows, and the first adjustment portion and the liquid reservoir are located opposite from each other across the second adjustment portion.

* * * * *